US006578403B2

(12) United States Patent
Gascoin

(10) Patent No.: US 6,578,403 B2
(45) Date of Patent: Jun. 17, 2003

(54) DEVICE FOR ADJUSTING THE HEIGHT OF A PLURALITY OF TOOL CARRIERS FOR A BENDING PRESS

(75) Inventor: Claude Gascoin, Laigne-en-Belin (FR)

(73) Assignee: Amada Europe, Tremblay-en-France (FR)

( * ) Notice: Subject to any disclaimer, the term of this patent is extended or adjusted under 35 U.S.C. 154(b) by 127 days.

(21) Appl. No.: 09/764,390

(22) Filed: Jan. 19, 2001

(65) Prior Publication Data

US 2001/0023608 A1 Sep. 27, 2001

(30) Foreign Application Priority Data

Jan. 21, 2000 (FR) ..... 00 00765

(51) Int. Cl.[7] ..... B21D 5/02; B21D 37/04
(52) U.S. Cl. ..... 72/389.4; 72/389.5
(58) Field of Search ..... 72/389.4, 389.5, 72/389.1

(56) References Cited

U.S. PATENT DOCUMENTS

| | | | | |
|---|---|---|---|---|
| 3,965,721 A | * | 6/1976 | Roch | 72/389.5 |
| 4,354,374 A | * | 10/1982 | Deguchi | 72/389.5 |
| 4,653,307 A | * | 3/1987 | Zbornik | 72/389.4 |
| 5,009,098 A | * | 4/1991 | van Merksteijn | 72/389.5 |
| 5,103,665 A | * | 4/1992 | van Merksteijn | 72/389.5 |
| 6,000,273 A | | 12/1999 | Stover | |
| 6,018,979 A | * | 2/2000 | Davis | 72/389.4 |

FOREIGN PATENT DOCUMENTS

| | | | |
|---|---|---|---|
| DE | 3921034 | 1/1990 | |
| EP | 0 404 269 | 12/1990 | |
| FR | 1 420 380 | 2/1966 | |
| FR | 2 427 148 | 12/1979 | |
| JP | 2316953 | * 10/1973 | 72/389.5 |
| JP | 60 108117 | 6/1985 | |
| JP | 360244425 | * 12/1985 | 72/389.5 |
| JP | 402055622 | * 2/1990 | 72/389.5 |
| JP | 402147120 | * 6/1990 | 72/389.4 |

* cited by examiner

*Primary Examiner*—David Jones
(74) *Attorney, Agent, or Firm*—Nath & Associates PLLC; Gary M. Nath; Marvin C. Berkowitz

(57) ABSTRACT

The present invention relates to a device for adjusting the height of a plurality of tool carriers connected to a top panel of a bending press, each tool carrier having a tool spacer, the adjustment device comprising, for each tool carrier, an adjustment wedge interposed between the square of the top panel and the top face of the tool spacer associated with said wedge. According to the invention, the ends of each wedge include engagement mechanism to enable a wedge associated with a tool spacer firstly to overlap at least part of the top face of an adjacent tool spacer, and secondly to engage reversibly with the wedge associated with said adjacent tool spacer so that the two adjacent tool spacers touch each other, and the square of the top panel is designed to bear against the engagement mechanism.

4 Claims, 3 Drawing Sheets

DEVICE FOR ADJUSTING THE HEIGHT OF A PLURALITY OF TOOL CARRIERS FOR A BENDING PRESS

The present invention relates to a device for adjusting the height of a plurality of tool carriers connected to a top panel of a bending press.

BACKGROUND OF THE INVENTION

In general, bending presses are used for forming sheet materials, and for this purpose they comprise a top panel and a bottom panel disposed in a common vertical plane. One of the two panels is fixed, being supported at its ends, while the other panel is movable and is moved in the vertical plane by drive members which are generally situated at its two ends. Depending on the type of bending press, the moving panel can be constituted either by the top panel or by the bottom panel.

For forming purposes, one or more tools are fixed on the top panel by means of tool carriers, in register with one or more V-shaped matrices which are fixed to the edge of the bottom panel.

Each tool carrier comprises a tool spacer disposed vertically in register with the top panel, said tool spacer co-operating with a locking clamp which applies sufficient pressure to the tool or punch to position it in locked manner on the tool spacer.

When forming sheet material using such bending presses, one of the problems encountered is that of ensuring that the various tools and the matrix or matrices are parallel, and more generally that of ensuring that the facing edges of the two panels are parallel.

During forming, i.e. under the action of bending forces, the longitudinal deformation curves of the top and bottom panels, each in the form of a single arc, are substantially symmetrical about the separation plane between the panels. Thus, the maximum spacing between the panels is situated in the vicinity of their center and represents twice the maximum deformation of each panel.

It will thus be understood that since the tools are fixed on tool carriers connected to the top panel, the tools will take up positions such that the notional curve passing via the respective leading edges of the tools will have the same appearance as the longitudinal deformation curve of the top panel.

Thus, since the notional curve for the tools is further away from the matrix in its middle than at its ends, the folding of sheet material is more open in the center than at the ends.

It will thus be understood that maintaining parallelism between the various tools and the matrix or matrices of the bottom panel is a parameter which is essential for the precision and the quality of the bending performed.

A known solution for solving this problem consists in providing a device for adjusting the height of the tool carriers of the top panel so as to modify the vertical distance between the square of the top panel and the leading edges of the various tools.

The "square" of the top panel is that portion of the panel or more exactly of the bottom face of the top panel which is placed facing the matrix of the bottom panel.

In conventional manner, the adjustment device comprises for each tool carrier, an adjustment wedge having a horizontal top face against which the square of the top panel is to bear while the bending press is working, i.e. during forming, and a sloping bottom face that bears against the top face of the tool spacer associated with said wedge.

The various wedges can slide independently of one another in the longitudinal direction of the top panel so as to adjust the vertical distance between each tool spacer and the square of the top panel, and thus above all the vertical distance between the leading edges of the tools and the square of the top panel.

That solution also makes it possible to compensate for deformation of the top panel during forming by adjusting the pre-curvature of the tool line, i.e. the line passing through the respective leading edges of the tools. This pre-curvature is in the form of a single arc parallel to that of the bottom panel.

Depending on circumstances, that solution also makes it possible to compensate for defects in the machining of the tools or in the machining of the top and bottom panels.

Nevertheless, in order for that solution to be satisfactory, it is essential for the length of the adjustment wedge to be greater than the length of the tool spacer with which it is associated so as to ensure that the bearing surface area between the horizontal top face of each adjustment wedge and the square of the top panel is sufficient to avoid local deformation of the top panel.

Furthermore, it is essential for the bearing surface area between each wedge and the square of the top panel to be conserved when the wedge moves relative to the tool spacer associated therewith while adjusting the height of the tool.

Thus, since the length of each wedge is necessarily longer than that of the tool spacer with which it is associated, the tool carriers serving to fix one or more tools have, until now, been spaced apart relative to one another. This spacing between two adjacent tool carriers corresponds substantially to the lengths of the end portions of two wedges projecting laterally beyond the top faces of the tool spacers.

Under such circumstances, and depending on the forming to be implemented, known adjustment wedges do not enable the tool carriers to be positioned, or more precisely do not enable the tool spacers to be positioned so that they touch one another while maintaining a sufficient bearing surface area between each wedge and the square of the panel.

It can be necessary, for example, for two tool spacers to be positioned so as to touch when the tool or fractioned tools need to be placed over a determined length equal to the sum of the lengths of the spacers so as to allow clearance for the side folds of sheet materials at the longitudinal ends of the lateral tool spacers.

Thus, it will be understood that with presently known adjustment wedges, if it is desired to place at least two tool spacers so that they touch each other, then the ends of the wedges associated with the tool spacers will necessarily come into contact with one another before the tool spacers themselves do.

Under such circumstances, it is not possible to make the spacers touch one another without moving at least one of the wedges and that would have the effect of modifying and thus spoiling the vertical adjustment of the spacer associated therewith.

OBJECTS AND SUMMARY OF THE INVENTION

An object of the present invention is to overcome the above-mentioned technical problems in satisfactory manner.

According to the invention, this object is achieved by means of a device for adjusting the height of a plurality of tool carriers connected to a top panel of a bending press, each tool carrier comprising a tool spacer disposed vertically in register with the top panel, the adjustment device comprising, for each tool carrier, an adjustment wedge which has a horizontal top face against which the square of the top panel is to bear while the bending press is in operation, and a sloping bottom face bearing against the top face of the tool spacer associated with said wedge, each wedge being of length greater than the length of the tool spacer associated therewith and being capable of sliding in the longitudinal direction of the folding press in order to adjust the height between each tool spacer and the top panel; wherein the ends of each wedge have engagement means to enable a wedge associated with a tool spacer firstly to overlap at least part of the top face of an adjacent tool spacer, and secondly to engage reversibly with the wedge associated with said adjacent tool spacer so that the two adjacent tool spacers touch one another, and wherein the square of the top panel can bear against the engagement means.

According to an advantageous further characteristic of the invention, the tool spacers are disposed in such a manner that their top faces have slope angles oriented in the same direction and the end portion of the top face of each tool spacer that is the closer to the top panel, is provided with a notch to enable the engagement means at one of the ends of the wedge associated with the adjacent tool spacer to come into contact with said notch.

According to yet another characteristic of the invention, the engagement means comprise a projecting element at one of the ends of each wedge, and, at the other end of each wedge, at least one end portion defining a recess of complementary shape, the projecting element of a wedge being designed to engage in the recess of complementary shape of the adjacent wedge.

According to yet another advantageous characteristic of the invention, the engagement means at the end of a wedge and the corresponding wedge are made as a single piece.

Thus, the device of the invention makes it possible to place at least two tool spacers so that they are touching while conserving sufficient bearing surface area between each adjustment wedge and the square of the top panel, and to do so independently firstly of the position of a wedge relative to the tool spacer which is associated therewith, and secondly of the positions of the wedges relative to one another.

BRIEF DESCRIPTION OF THE DRAWINGS

Other characteristics and advantages of the invention will appear more clearly on reading the following description accompanied by the drawings, in which.

MORE DETAILED DESCRIPTION

Figure 1:
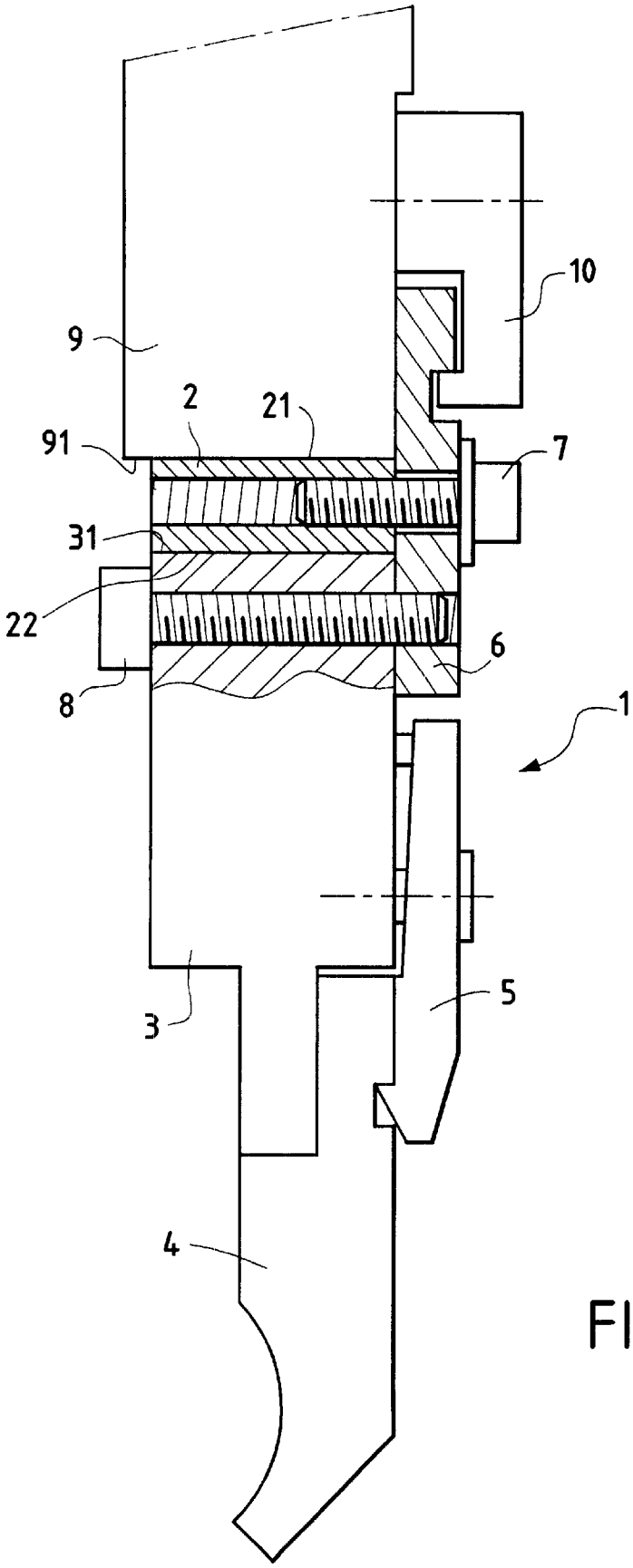
FIG. 1 is an elevation view partially in cross-section of a bending press tool carrier together with its height adjustment device.

FIG. 1 is an elevation view in partial cross-section of a tool carrier 1 mounted on a top panel 9 of a bending press. The tool carrier 1 comprises a tool spacer 3 whose vertical position, i.e. whose height, can be adjusted by means of an adjustment device of the invention.

Before embarking on a detailed description of the adjustment device itself, a particular embodiment of a tool carrier is described by way of non-limiting example, which tool carrier, when co-operating with at least one other identical tool carrier enables the adjustment device of the invention to be used.

The top panel 9 of the bending press, as shown in FIG. 1, has a plurality of tool carriers 1 disposed horizontally one after another along its length.

Each tool carrier 1 is connected to the top panel 9 by means of a fixing clamp 10. Each tool carrier comprises a fixing spacer 6 to which the tool spacer 3 is fixed by means of one or more screws 8. The tool spacer 3 is located vertically in register with the top panel 9, and beneath it, and it is intended to co-operate with a locking clamp 5 which applies sufficient pressure on the tool 4 to lock it in position against the tool spacer 3.

In order to ensure that the tool 4 is properly fixed on the tool carrier 1, the locking clamp 5 and the tool spacer 3 are identical in length.

Depending on the type of forming to be performed by the bending press, each tool carrier 1 is provided with a fractioned tool or else a single tool can be fixed to a plurality of tool carriers identical to that shown in FIG. 1.

In order to adjust the vertical position of each tool carrier 1, and more precisely the vertical position of each tool spacer 3 so as to modify the ideal curve of fractioned tools or, where appropriate, of a single tool supported by a plurality of tool carriers, the adjustment device comprises, for each tool carrier, an adjustment wedge 2 placed between the top panel 9 and the tool spacer 3 that is associated with the wedge.

Figure 2:
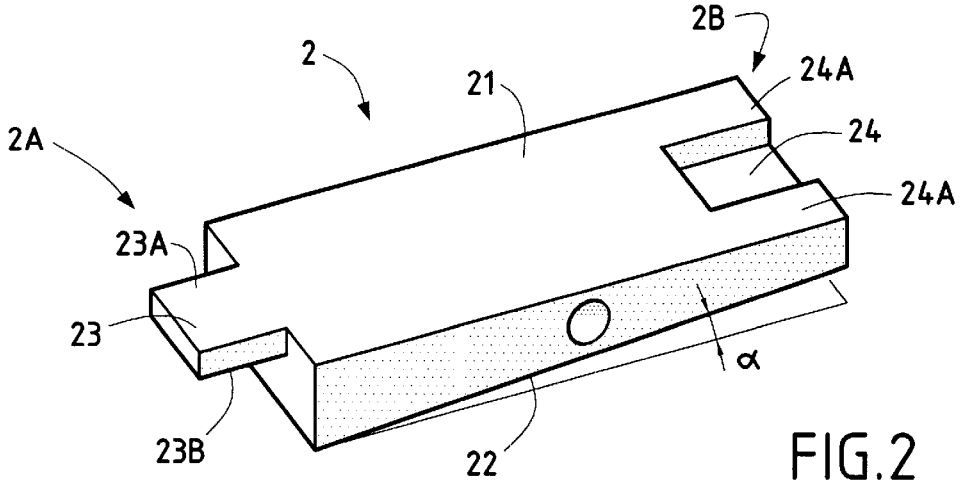
FIG. 2 is a perspective view of a first embodiment of an adjustment wedge for the device of the invention.
Figure 4:
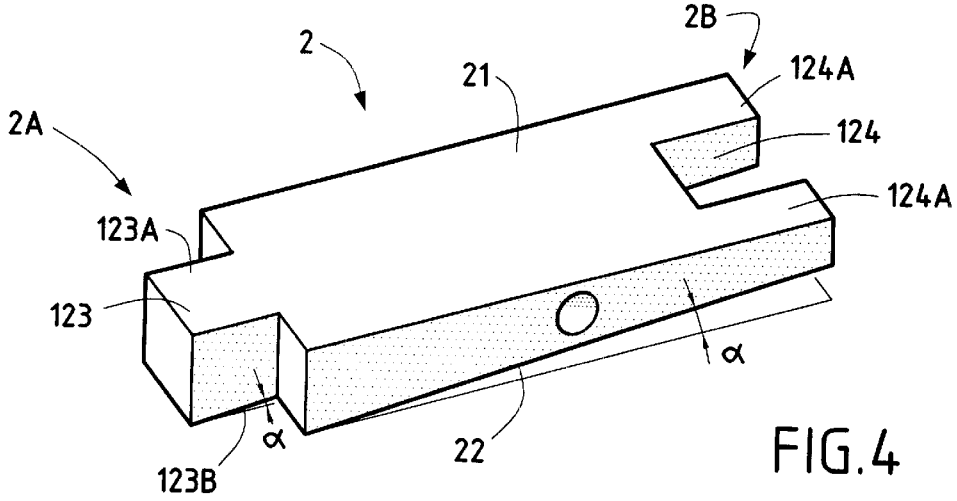
FIG. 4 is a perspective view of a second embodiment of an adjustment wedge of the device of the invention.

As can be seen in FIG. 1, and more particularly in FIGS. 2 and 4 which show first and second embodiments of the invention respectively, each adjustment wedge has a horizontal top face 21 for bearing against the square 91 of the top panel 9 and a sloping bottom face 22 which slopes at an angle $\alpha$ relative to the horizontal, said sloping bottom face 22 bearing against the sloping top face 31 of the tool spacer 3 that is associated therewith and that possesses the same slope angle $\alpha$.

Figure 3:
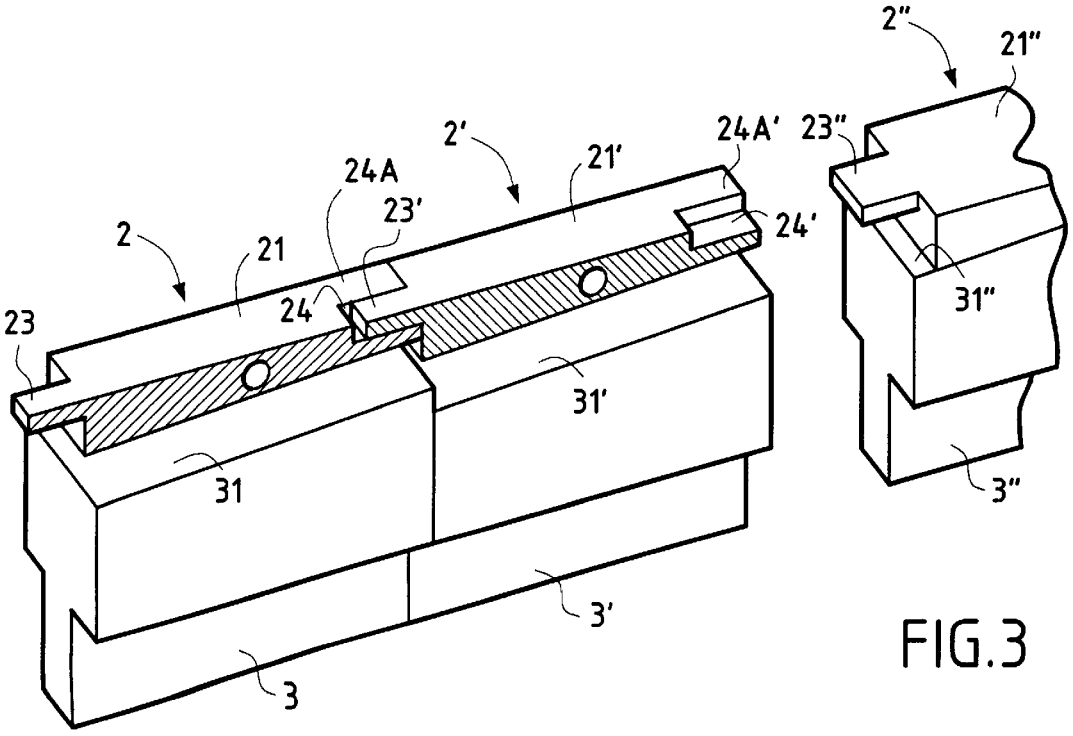
FIG. 3 is a diagrammatic perspective view showing the positioning of a plurality of adjustment wedges relative to the tool spacers associated therewith in the first embodiment.
Figure 5:
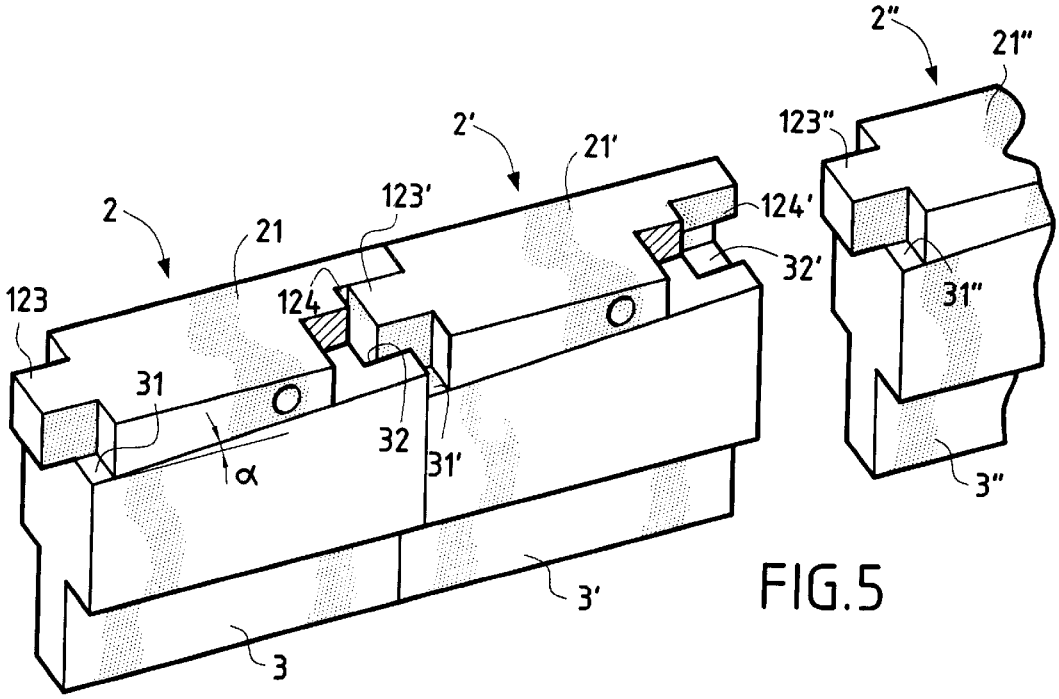
FIG. 5 is a diagrammatic perspective view showing a plurality of adjustment wedges positioned relative to the tool spacers associated therewith in the second embodiment.

Furthermore, the length of the adjustment wedge 2 is longer than the length of the tool spacer 3 that is associated therewith (see FIGS. 3 and 5).

In order to ensure that the bending press operates correctly while the top panel 9 is moving downwards or the bottom panel is moving upwards, the adjustment wedge 2 is secured to the tool spacer 3 (FIG. 1) by means of the fixing spacer 6 which is fixed firstly to the adjustment wedge 2 by means of a screw 7 and secondly to the tool spacer 3 by means of a screw 8, the top portion of the fixing spacer 6 being likewise mounted on the top panel 9 via the fixing clamp 10 which is secured thereto.

In order to adjust the vertical position of the tool spacer 3 relative to the square 91 of the top panel 9, it therefore suffices to loosen the screw 7, to move the adjustment wedge 2 longitudinally by any suitable means, with the screw 7 then moving in an oblong hole formed through the fixing spacer 6, and then to retighten the screw 7 as soon as the vertical position for the tool spacer 3 has been reached.

As mentioned above, each conventional adjustment wedge is of a length that is longer than that of the tool spacer associated therewith. However, when it is desired to ensure that two tool spacers touch one another, it is essential for the ends of the two adjacent wedges not to come into contact.

To avoid that drawback, the invention provides for the end of each wedge to have engagement means enabling a wedge associated with a tool spacer firstly to overlap at least in part the top face of the adjacent tool spacer and secondly to engage in reversible manner with the wedge associated with said adjacent tool spacer, and to do so while maintaining sufficient bearing surface area between the square 91 of the top panel 9 and the engagement means whose top surfaces are in alignment with the top surface of the corresponding wedge.

In a first embodiment of the invention, shown in FIGS. 2 and 3, the engagement means at the end 2A of the adjustment wedge 2 are constituted by a projecting element 23 having a horizontal top face 23A and a horizontal bottom face 23B. The top face 23A of the projecting element 23 extends the horizontal top face 21 of the adjustment wedge so as to form a continuous bearing surface between the square 91 of the top panel 9 and the respective top faces 23A and 21 of the projecting element 23 and the adjustment wedge 2.

At the second end 2B of the wedge 2, the engagement means are constituted by a recess 24 having a horizontal bottom defined by two end side portions 24A whose top faces are for bearing against the square 91 of the top panel 9 and which are in alignment with the top face 21 of the corresponding wedge 2.

The recess 24 is made in such a manner that the projecting element 23' (FIG. 3) of the adjacent wedge 2', which is identical to the projecting element 23 of the first wedge 2, can engage in the recess 24 of the first wedge.

Furthermore, the depth of the recess 24 is determined so that the bottom face of the projecting element 23' bears against the horizontal bottom of the recess 24 and the height of the projecting element 23' is determined so that its top face is situated level with the top face 21 of the adjustment wedge 2 and the top faces of the opposite end side portions 24A.

The tool spacers 3, 3', and 3" are disposed in such a manner that their respective top faces 31, 31', 31" have a slope angle α that is oriented in the same direction relative to the horizontal.

Thus, when for reasons specific to the forming to be applied to the sheet material, it is desired to place at least two tool spacers 3 and 3' so that they touch each other (FIG. 3), the second adjustment wedge 2' associated with the second tool spacer 3' or more exactly the projecting element 23' of the second wedge 2' overlaps at least part of the top face 31 of the adjacent first tool spacer 3 while engaging in reversible manner in the recess 24 of the first adjustment wedge 2.

Furthermore, the top faces 21, 21', and 21" of the wedges 2, 2', and 2" and the engagement means at their ends constituted by the projecting elements 23, 23', and 23" and by the end side portions 24A and 24A' defining the recesses 24 and 24' respectively enable the assembly constituted by the wedges 2, 2', and 2" to conserve sufficient bearing surface area against the square 91 of the top panel 9.

In a second embodiment of the invention, as shown in FIGS. 4 and 5, the engagement means at the end 2A of the adjustment wedge 2 are constituted by a projecting element 123 whose horizontal top surface 123A is situated level with the horizontal top surface 21 of the adjustment wedge 2 while its sloping bottom 123B extends the sloping bottom face 22 of the adjustment wedge.

Thus, since the bottom surfaces 123B and 22 of the projecting element 123 and of the wedge 2 have the same slope angle α relative to the horizontal, these two bear permanently against the top face 31 of the tool spacer 3 which has a complementary slope angle.

At the second end 23 of the wedge 2, the engagement means are constituted by a recess 124 which opens out in the bottom face 22 and the top face 21 of the wedge. This recess 124 is defined transversely by two end side portions 124A designed to bear against the square 91 of the top panel 9.

As can be seen in FIG. 5, the tool spacers 3, 3', and 3" are placed in such a manner that their respective top faces 31, 31', and 31" are at a slope angle α relative to the horizontal that is oriented in the same direction as the slope angle of the corresponding wedge.

These slope angles of the top faces 31, 31', and 31" can have the same value as one another or they can have different values depending on the tool spacers used, however each of them is identical in value to that of the bottom face 22 of the corresponding adjustment wedge 2, 2', or 2".

Since the bottom face of each projecting element 123, 123' and 123" extends the bottom face of the corresponding adjustment wedge 2, 2', and 2", the end portions of the top faces 31, 31', and 31" of the tool spacers 3, 3', and 3" the closer to the top panel 9 are advantageously provided with notches 32, 32' so that the various projecting elements 123, 123', and 123" situated at the thicker ends, i.e. the taller ends of the wedges 2, 2', and 2" can slide over and cover the adjacent tool spacers 3, 3' which are at their tallest at the corresponding ends.

Advantageously, each notch 32, 32' has a slope angle identical to the slope angle of the bottom face of the adjacent projecting element 123', 123" so that said projecting element 123' and/or 123" which is engaged in the recess 124 or 124' comes into contact both with the adjacent tool spacer and with the square 91 of the top panel.

Thus, the device of the invention makes it possible to place at least two tool spacers so that they touch each other while conserving sufficient bearing surface area between the square 91 of the panel 9 and the top surfaces 21, 21', and 21" and the engagement means of the adjustment wedges 2, 2', and 2", since the top faces of said engagement means are in alignment with the top faces 21, 21', and 21" of said wedges 2, 2', 2". In addition, this touching disposition of the spacers is independent both of the relative position of a wedge relative to the tool spacer with which it is associated and of the positions of the wedges relative to one another.

In the second embodiment, the projecting element 123, 123', or 123" of each adjustment wedge is placed on the longitudinal axis of symmetry of the wedge. Nevertheless, it would also be possible to offset each projecting element transversely so that one of the side faces thereof lies in register with one of the side faces of the wedge. Under such circumstances, the end 2B of each wedge is provided with a single end portion only defining a recess having two plane faces complementary to the immediately adjacent projecting element.

Naturally, the invention is not limited in any way to the embodiments described and shown which have been given purely by way of example. In particular, the invention covers all means constituting technical equivalents to the means described and combinations thereof providing they are implemented within the spirit of the invention and the ambit of the following claims.

What is claimed is:

1. A device for adjusting the height of a plurality of tool carriers of a bending press having a top panel provided with a square, said tool carriers being connected to said top panel, each tool carrier comprising a tool spacer having a top face, a length and two end portions, disposed vertically in register with said top panel, said adjustment device comprising, for each tool carrier, an adjustment wedge having a horizontal top face against which said square of the top panel is to bear while the bending press is in operation, and a sloping bottom face bearing against said top face of the tool spacer associated with said wedge, each wedge being of length greater than the length of the tool spacer associated therewith and being capable of sliding in a longitudinal direction of the bending press in order to adjust a distance between each tool spacer and the top panel;

wherein the ends of each wedge have engagement means to enable a wedge associated with a tool spacer firstly to overlap at least part of the top face of an adjacent tool spacer, and secondly to engage reversibly with the wedge associated with said adjacent tool spacer so that the two adjacent tool spacers touch one another, and wherein the square of the top panel can bear against the engagement means as well as on the corresponding wedges.

2. A device according to claim 1, wherein the tool spacers are disposed in such a manner that said top faces of the tool spacers have slope angles oriented in the same direction and wherein one of the two end portions of the top face of each tool spacer, which is closer to said top panel, is provided with a notch to enable said engagement means at one of the ends of the wedge associated with the adjacent tool spacer to come into contact with said notch.

3. A device according to claim 1, wherein the engagement means comprise a projecting element at one of the ends of each wedge, and, at the other end of each wedge, at least one end portion defining a recess of complementary shape, and wherein the projecting element of a wedge is designed to engage in the recess of complementary shape of the adjacent wedge.

4. A device according to claim 1, wherein the engagement means at the end of a wedge and the corresponding wedge are made as a single piece.

* * * * *